United States Patent [19]

Hurley et al.

[11] Patent Number: 4,460,026

[45] Date of Patent: Jul. 17, 1984

[54] LIQUID FILLING APPARATUS AND METHOD

[76] Inventors: Byron H. Hurley, Rte. 1, Box 214-B, Julian, N.C. 27283; Walter G. Ricks, Rte. 1, Box 108-C, Pleasant Garden, N.C. 27313

[21] Appl. No.: 348,847

[22] Filed: Feb. 16, 1982

[51] Int. Cl.[3] ..... B67C 3/04

[52] U.S. Cl. ..... 141/1; 141/284; 222/56

[58] Field of Search ..... 141/1, 83, 95, 157, 141/158, 181, 182, 192, 193, 198, 221, 222, 250, 251, 253, 263, 264, 266, 284, 288, 368, 374, 376; 222/56, 160, 438, 440

[56] References Cited

U.S. PATENT DOCUMENTS

| | | | |
|---|---|---|---|
| 1,307,898 | 6/1919 | Daum | 141/175 X |
| 1,360,023 | 11/1920 | Risser | 141/284 X |
| 2,522,884 | 9/1950 | Mann | 141/284 X |
| 2,717,112 | 9/1955 | Ralston | 141/376 X |
| 2,721,021 | 10/1955 | Day et al. | 141/284 X |
| 2,770,263 | 11/1956 | Breeback | 141/368 X |
| 2,793,659 | 5/1957 | Guerard, Jr. et al. | 141/181 |
| 3,100,513 | 8/1963 | Cozzoli et al. | 141/102 |
| 3,133,726 | 5/1964 | Tarukawa | 222/56 X |
| 3,181,576 | 5/1965 | Pellerino et al. | 141/293 |
| 3,443,608 | 5/1969 | Copping et al. | 141/46 |
| 3,580,298 | 5/1971 | Trusselle | 141/40 |
| 3,610,398 | 10/1971 | Rice | 141/168 X |
| 3,828,833 | 8/1974 | Smith et al. | 141/85 |
| 3,933,272 | 1/1976 | Lamb et al. | 222/440 X |
| 4,141,394 | 2/1979 | Lassman et al. | 141/284 |

*Primary Examiner*—Stephen Marcus
*Assistant Examiner*—Mark Thronson

[57] ABSTRACT

The invention presented herein demonstrates an apparatus and method whereby selected containers can be filled with a precise amount of a desired liquid in rapid fashion. The displacement rod of the liquid reservoir is adjusted to insure that the container is charged with the exact amount of liquid required.

8 Claims, 5 Drawing Figures

LIQUID FILLING APPARATUS AND METHOD

BACKGROUND AND OBJECTIVES OF THE INVENTION

Manufacturers and distributors of various consumable liquids such as soft drink syrups continually package and fill empty containers for distribution to soda fountains and other users. It is commonplace to ship syrup in five-gallon cannisters to coffee shops, soda fountains or the like. The five-gallon cannisters are then pressurized and the syrup therein is discharged in small amounts for mixing with carbonated water and dispensed in individual servings. Periodically the distributor exchanges the dispensed cannisters for freshly filled ones and the empty cannisters are returned to the distributor's plant for cleaning and refilling. It is not uncommon to find cannisters having various sizes with differences in diameters and heights. Therefore, the distributor cannot completely rely on a marking on the cannister to ensure an accurate filling and oftentimes cannisters are under or overfilled by several ounces resulting in either a loss of profits when the cannister is overfilled or possibly the loss of a customer if an insufficient amount of syrup is inadvertently delivered. Hence, it is desirable to uniformly fill the cannisters within 1% or less of the stated capacity of the cannister without the costly step of measuring or weighing each container as it is being filled or after filling has been completed.

Also, it is quite important to the distributor or bottler to have the containers be filled at a relatively high speed so maximum efficiency of the operation will be realized. However, high speed fillings often result in foaming of the syrup which can cause inaccuracies in the filling procedures and can result in lost time as the foam is allowed to settle so the actual height of the liquid in the cannister can be observed.

With the problems encountered in conventional syrup filling operations, the present invention was developed and one of its objectives is to provide apparatus and a method for delivering a precise amount of the liquid to a container.

It is another objective of the present invention to provide an apparatus and method of filling which will allow the bottling plant to operate at maximum efficiency by rapidly filling the containers while minimizing the foam formation.

It is still another objective of the present invention to provide liquid filling apparatus which is relatively inexpensive yet which will remain accurate in its liquid delivery over a long period of time.

It is also an objective of the present invention to provide liquid filling apparatus which includes an adjustable displacement means for adjusting the amount of liquid which is to be delivered to a particular size container.

It is yet another objective of the present invention to provide liquid filling apparatus and a method for operating the same which allows the liquid reservoir to withdraw from the container during the filling procedure.

Other objectives and advantages of the present invention will become obvious from the description which follows below.

DESCRIPTION OF THE PREFERRED EMBODIMENT

The apparatus of the preferred embodiment includes a reservoir means which comprises a liquid receptacle having a body portion and a neck portion with said neck portion smaller in diameter than said body portion. Said reservoir means includes a liquid displacement means which may be adjustably positioned at a desired height within said reservoir means. An elevating means is connected to said reservoir means for raising and lowering said reservoir means as required during the filling process. Control circuitry communicates with the reservoir means whereby an exact amount of liquid can be delivered to said reservoir means and thereafter discharged to a container in a timed sequence to insure the most rapid and efficient filling operation. Reservoir body portion has hemispherical-shaped upper and lower sections to prevent fluid entrapment in said body portion if reservoir means is positioned on an incline during filling or liquid discharge. In the preferred method of filling containers, a displacing means is adjusted to the desired position in the liquid reservoir. Thereafter, the reservoir is filled with a precise amount of the selected liquid and the reservoir is then lowered to the container to be filled. Liquid in the reservoir is then discharged into the container as the reservoir is elevated to the container during the discharge cycle.

DESCRIPTION OF THE DRAWINGS

For a more complete description of the invention, turning now to the drawings,

For a more detailed description of the drawings, FIG. 1 illustrates the liquid filling apparatus 10 with a plurality of reservoir means 11 featured in an elevated position. Reservoir means 11 includes a body portion 12 and a neck portion 43 of substantially smaller diameter than body portion 12. Reservoir discharge tube 13 which communicates with body portion 12 is shown extending below body portion 12 and above liquid containers 14.

Figure 1:
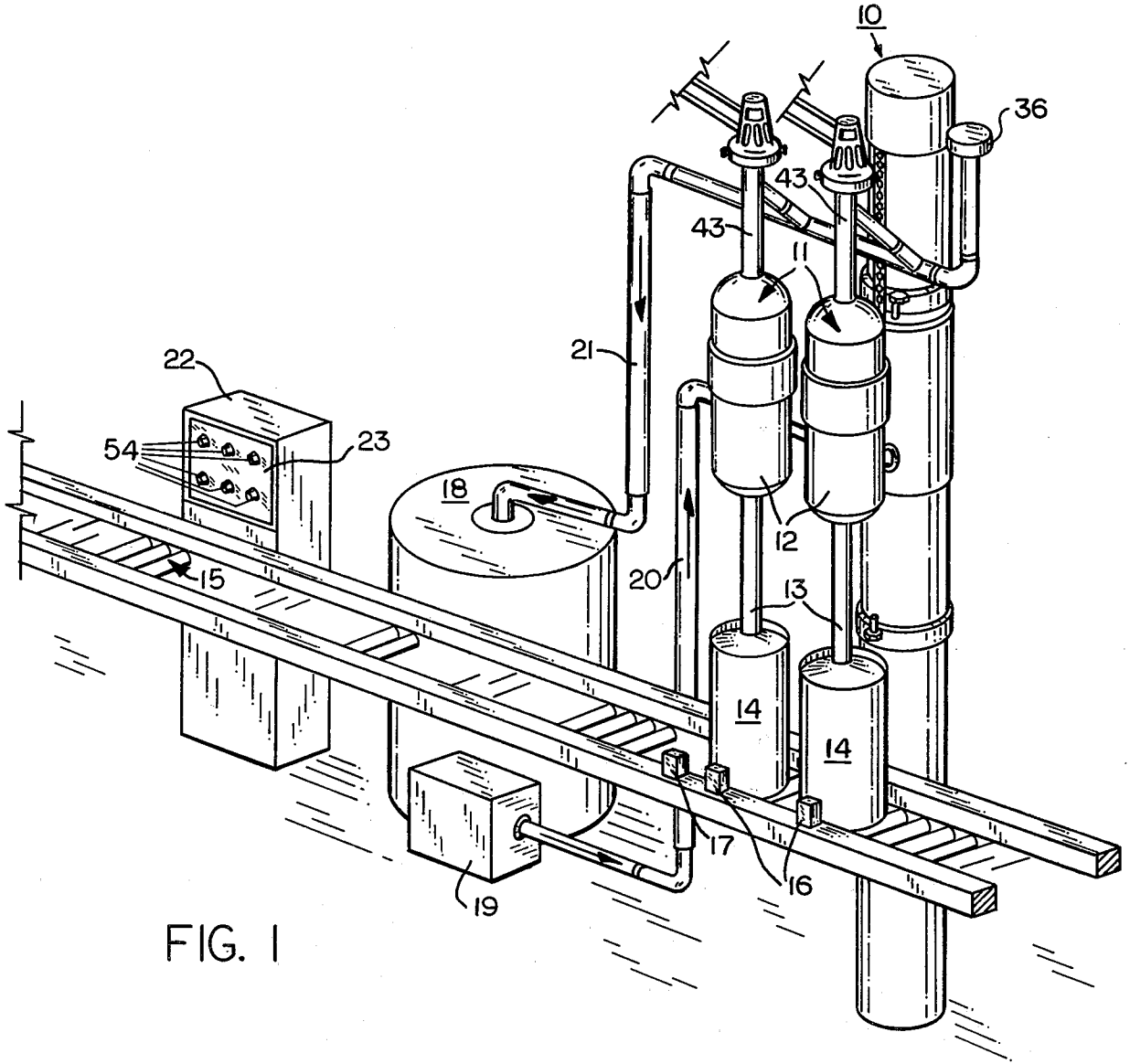
FIG. 1 is a perspective view of the liquid filling apparatus of the present invention.

Containers 14 pass along conveying means 15 from right to left as shown in FIG. 1. Container sensing means 16 are shown positioned on conveying means 15 and are proximity switches which can "sense" containers 14 as they approach and disturb the generated field. Also shown on conveying means 15 is container stop means 17 which comprises an air cylinder having a piston rod which extends into the path of container 14 as it moves along conveying means 15 to terminate its progress at the desired location.

As would be understood, liquid filling apparatus 10 may contain one or more reservoir means 11 as shown in FIG. 1 depending on the requirements of a specific filling operation.

Also shown in FIG. 1 is liquid holding tank 18 which provides a source of supply for filling apparatus 10. Liquid is urged from holding tank 18 by pump means 19 through delivery hose 20 and any excess liquid is returned to holding tank 18 through return line 21.

Featured beside liquid holding tank 18 is control unit 22 with a front control panel 23. A series of control dials or buttons 54 are shown on front control panel 23 which would be used by the operator in utilizing filling apparatus 10. Control unit 22 contains a portion of control circuitry 40 (not shown) having a programmable controller 32 (also not shown in FIG. 1) having memory and timer units such as are commercially available from various manufacturers including Westinghouse, Texas Instruments and are generally well known in the art.

Figure 2:
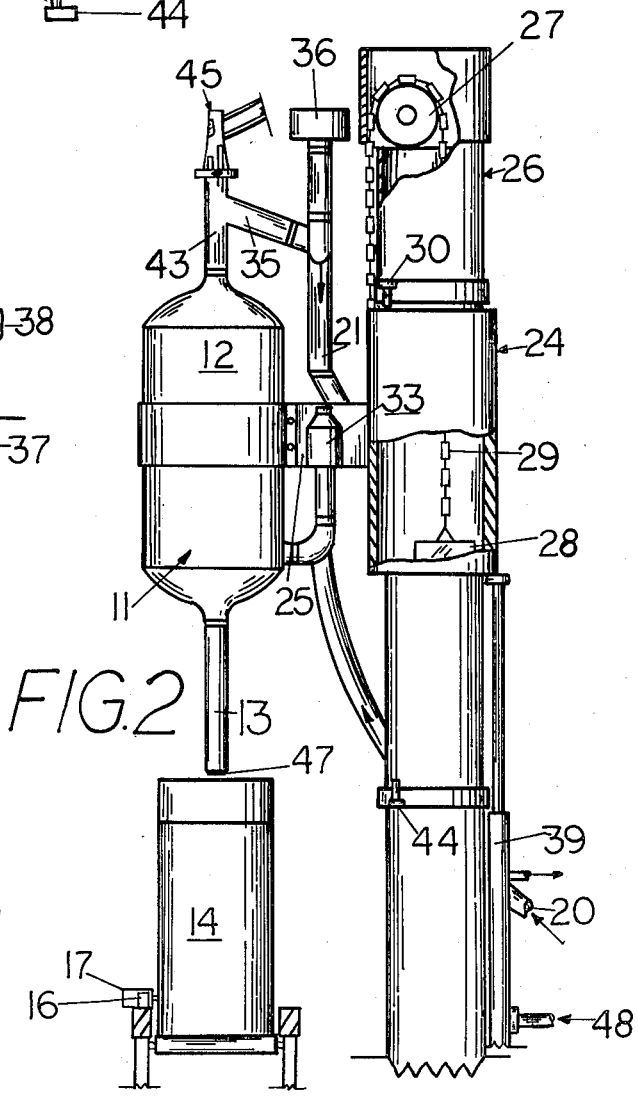
FIG. 2 is a side elevation view of the apparatus as shown in FIG. 1.

During the operation of filling apparatus 10, reservoir means 11 is raised to its highest position by elevating means 24 as shown in FIG. 2 which is joined to reservoir means 11 by reservoir support 25 as also shown in FIG. 2. Elevating means 24 encircles stanchion 26 and is slidably positioned thereon. Stanchion 26 is shown in cut-away fashion in FIG. 2 and includes pulley means 27 which guidably supports counterpoise 28 by counterpoise guideline 29. Guideline 29 may be for example a link chain of sufficient size or may be a braided cable or other suitable cord which will support counterpoise member 28 which may be constructed of lead or other suitable dense materials.

Figure 4:
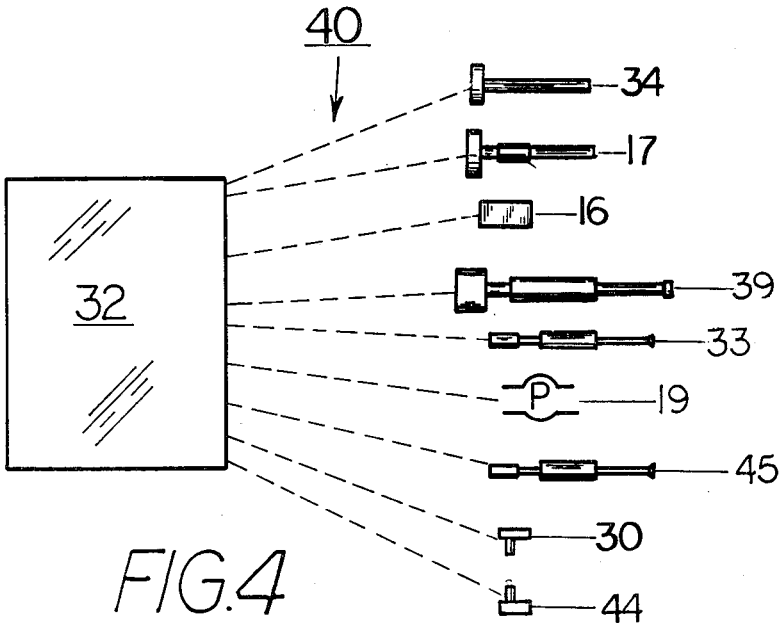
FIG. 4 demonstrates a schematic view of the control circuitry of the invention.

Elevating means 24 contacts upper elevating switch means 30 at the zenith of its upward movement whereupon the activation of upper elevating switch means 30, which may be for example a proximity switch, a signal is transmitted through control circuitry 40 as shown in schematic fashion in FIG. 4 to the programmable controller 32. Programmable controller 32, according to its pre-fed instructions, delays for approximately one second at which time programmable controller 32 then transmits a signal to pump means 19 and to fill tank control means 33 which may be a pneumatic valve whereupon pump means 19 then urges liquid which may be for example a soft drink syrup, from liquid holding tank 18 through delivery line 20 to fill tank control means 33 and on to reservoir means 11. Reservoir means 11 remains in its elevated posture, provided containers 14 are not in position during the filling process. During filling body portion 12 is first filled and thereafter the liquid rises in neck portion 43. If containers 14 are properly positioned, then reservoir means 11 are lowered even if they are in the process of being filled. The liquid continues to rise in neck portion 43 until the meniscus of the liquid touches sensing probe 34 shown in more detail in FIG. 3. The tip of sensing probe 34 is aligned with overflow spout 35 so that an excess amount of liquid or foam will be returned to holding tank 18 through return line 21. To prevent a vapor lock, vent means 36 is utilized and is shown in communication with return line 21. Sensing probe 34 is an electrical conductor which is in communication with programmable controller 32 which upon contact with the liquid transmits a signal through control circuitry 40 as shown in FIG. 4 to programmable controller 32.

Figure 3:
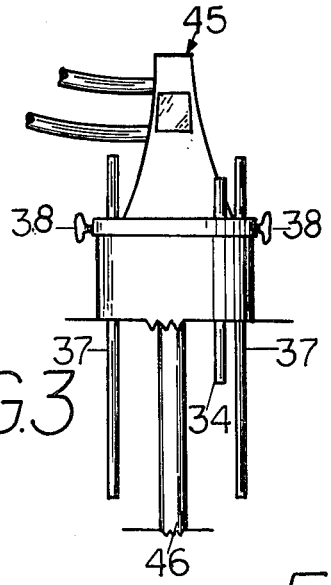
FIG. 3 illustrates the upper portion of the reservoir means removed from the body portion.

In order to make an exacting adjustment of the volume of liquid contained in reservoir means 11, a pair of displacement rods 37 are shown in partial form in FIG. 3. Displacement rods 37 extend into the neck portion 43 of reservoir means 11 beyond overflow spout 35 and may, if required, extend into reservoir body portion 12. Rods 37 are adjustably fixed in position and adjusting means 38 shown in FIG. 3 as thumb screws may be used to hold rods 37 in a secure manner. Rods 37 can be raised or lowered as necessary to respectively increase or decrease the amount of liquid which flows into reservoir means 11 and may be, for example, stainless steel rods of the same or different sizes as required for the particular application and can be adjustably positioned or removed entirely if required. During the use of filling apparatus 10, if it were determined that containers 14 were receiving, for example, one ounce of syrup in excess of the required amount, then one or both of displacement rods 37 would be lowered an amount to displace an additional liquid ounce. Calibrations may be placed on the displacement rods as required at fixed intervals to accommodate the operators in making precise adjustments.

The signal delivered by sensing probe 34 to programmable controller 32 begins a timing cycle in controller 32 which may run for approximately one second. At the conclusion of the timed cycle, programmable controller 32 activates reservoir control means 33 to close it and pump means 19 to terminate the delivery of the liquid.

By the time pump means 19 has been shut off, an empty container 14 should be positioned below reservoir means 11 with conveyor stop means 17 having terminated the containers' 14 progress along conveying means 15. Container sensing means 16, upon sensing the presence of container 14, communicates with programmable controller 32 whereby programmable controller 32 then directs a signal through the control circuitry 40 to elevator control means 39. As would be understood by those skilled in the art, programmable controller 32 would direct an electrical signal to a solenoid (not shown) contained within control unit 22 which would then open and allow air to flow from elevator control means 39 which as shown herein is a suitably dimensioned air cylinder as shown in FIG. 2. As reservoir means 11 descends reservoir discharge tube 13 enters container 14 and lower elevating switch means 44 is contacted by elevating means 24. A signal is delivered from lower elevating switch means 44 through control circuitry 40 to programmable controller 32 and controller 32 in turn transmits a signal to reservoir control means 45. Reservoir control means 45 comprises a solenoid (not shown) and an air cylinder positioned above neck portion 43 of reservoir means 11. Reservoir control means 45 is connected to valve stem 46 which passes through reservoir means 11 and terminates at the lower end of reservoir discharge tube 13. At the lower end of valve stem 46 is valve means 47 shown in open configuration in FIG. 5(*b*). As air enters reservoir control means 45 valve stem 46 joined thereto extends to thereby open reservoir discharge tube 13 and allow the liquid contained within reservoir means 11 to flow into liquid container 14. Additionally, programmable controller 32 transmits a signal through control circuitry 40 after approximately a one-second delay, to elevator control means 39 (through its solenoid) whereupon air is delivered to elevator control means 39 thereby causing elevating means 24 to begin its upward path. As would be understood counterpoise 28 descends as elevating means 24 rises. Thus, reservoir means 11 is drained of its liquid as it is being lifted upwardly with reservoir discharge tube 13 being raised out of container 14. The rate of elevation of reservoir means 11 is determined so that valve means 47 will just be covered by the liquid within container 14 to reduce the foam formation. The hemispherical upper and lower sections of body portion 12 prevent liquid or gas entrapment during filling and liquid discharge. A flow control means 48 is used to regulate the air of elevator means 39 so the speed of the ascent of reservoir means 11 can be accurately adjusted.

Figure 5:
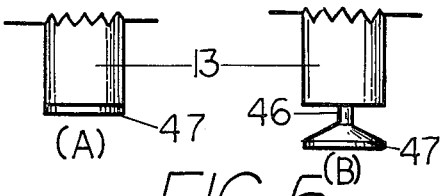
FIG. 5 shows the discharge valve of the reservoir in (a) closed and (b) open conditions.

As elevating means 24 moves upwardly along stanchion 26 upper elevating switch means 30 is eventually contacted. Upon contact, upper elevating switch means 30 transmits a signal to programmable controller 32 which, after a suitable time period (which can be adjusted as required) transmits signals to (1) reservoir control means 45 which in turn closes reservoir discharge tube 13 as shown in FIG. 5(*a*); (2) delivery line control means 33 so it will open; (3) allows container stop means 17 to open to allow the filled can or cans to move down conveying means 15; (4) allows pump means 19 to begin the delivery of additional liquid from liquid holding tank 18 to reservoir means 11; (5) and allows conveyor stop means 17 to return to a closed position so another container 14 will be properly positioned for receiving liquid.

When container sensing means 16 determines that a container is properly positioned, a signal is sent to programmable controller 32 which, after a suitable timing sequence, signals elevator control means 39 and the fill cycle is again initiated.

As would be understood the programmable controller 32 may have additional features than those described herein and the timing sequences can be adjusted by allowing for longer or shorter delays between the filling steps as required. Also, the control circuitry 40 shown schematically in FIG. 4 is concerned with electrical signals and of course the electrical signals may be used to regulate solenoids or other electrical, mechanical or pneumatic devices as desired.

The examples and illustrations herein may be modified by those skilled in the art and as such are not intended to limit the scope of the invention.

We claim:

1. Liquid filling apparatus for delivering an exact amount of liquid to a container comprising: a reservoir, an adjustable displacement means, said displacement means positioned within said reservoir, elevating means, said elevating means positioned for varying the distance between said reservoir and the container, said elevating means including a stanchion, a reservoir support means, said support means elevatable from a lower to an upper position, said support means being firmly attached to said reservoir and slidably connected to said stanchion, a counterpoise, said counterpoise joined to said support means, control circuitry, and said circuitry including a programmable controller and elevating sensing means whereby said circuitry controls the elevation of said reservoir relative to the container.

2. Liquid filling apparatus as claimed in claim 1 wherein said reservoir has a body portion and a neck portion, said neck portion being smaller than said body portion.

3. Liquid filling apparatus as claimed in claim 1 wherein said reservoir includes a liquid sensing means.

4. Liquid filling apparatus as claimed in claim 1 wherein said control circuitry includes a first control means, said first control means positioned on said reservoir, a second control means, said second control means positioned on said elevating means, a third control means, said third control means positioned on said reservoir, and said controller communicating with said first, second, and third control means.

5. The process of delivering liquid to a container comprising the steps of: adjusting the position of a displacing means in a liquid reservoir, filling said reservoir with liquid by pumping the liquid into the reservoir until said liquid contacts a liquid sensing means, sending a signal from the sensing means to a programmable controller to activate a timing cycle, positioning said reservoir relative to the container for fluid discharge, discharging the liquid from said reservoir, and elevating said reservoir relative to the container during the discharge.

6. The process of delivering liquid to a container as claimed in claim 5 wherein adjusting the position of a displacing means comprises moving the displacing means in a vertical direction and thereafter securing the displacing means.

7. The process of delivering a liquid as claimed in claim 5 wherein discharging said liquid comprises: opening a discharge port, allowing the liquid to flow through said discharge port, terminating the elevating of said reservoir, and thereafter closing said discharge port.

8. The process of delivering liquid to a container comprising the steps of: adjusting the position of a displacing means in a liquid reservoir having a support means slideably joined to a stanchion, filling said reservoir with liquid by directing the liquid into the reservoir until said liquid contacts a liquid sensing means, sending a signal from the sensing means to a programmable controller to activate a timing cycle, positioning said reservoir relative to the container for fluid discharge, discharging the liquid from said reservoir, and elevating said reservoir relative to the container during the discharge by controllably lowering a counterpoise joined to said support means.

* * * * *